US006469236B1

(12) United States Patent
Chen

(10) Patent No.: US 6,469,236 B1
(45) Date of Patent: Oct. 22, 2002

(54) ORNAMENTAL DISPLAY ASSEMBLY

(76) Inventor: Yu-Kai Chen, No. 2-2, Lane 15, Da-Hsing St., Tan-Shui Town (TW)

( * ) Notice: Subject to any disclaimer, the term of this patent is extended or adjusted under 35 U.S.C. 154(b) by 0 days.

(21) Appl. No.: 09/550,466

(22) Filed: Apr. 17, 2000

(51) Int. Cl.[7] ..... G10F 1/06
(52) U.S. Cl. ..... 84/94.1; 84/95.2
(58) Field of Search ..... 84/94.1, 94.2, 84/95.1, 95.2, 96, 97, 98, 99

(56) References Cited

U.S. PATENT DOCUMENTS 5,705,759 A * 1/1998 DeVivo ..... 84/95.2

* cited by examiner

*Primary Examiner*—Robert E. Nappi
*Assistant Examiner*—Kim Lockett

(74) *Attorney, Agent, or Firm*—Howard J. Klein

(57) ABSTRACT

Disclosed is an ornamental display assembly which includes a base, first and second coaxially arranged support members, a common drive mechanism mounted on the base and coupled to the first and second coaxially arranged support members, wherein the drive mechanism includes a music box mechanism and a rotating device, a first ornament supported and driven by the first support member, and a second ornament coupled with the second support member. When the common drive mechanism is actuated, the first support member is rotated by the rotating device while the second support member is rotated by the drive mechanism, thereby respectively causing the first and second ornaments to rotate in different manners. Alternatively, the ornamental display assembly further includes a following device disposed between the first support member and the rotating device for being coupled with the first support member and the rotating device to cause the first support member to rotate in a direction opposite to that of the second support member.

23 Claims, 9 Drawing Sheets

ORNAMENTAL DISPLAY ASSEMBLY

FIELD OF THE INVENTION

The present invention relates to a transmission mechanism for a music box having a plurality of ornaments coupled thereon, and especially to an ornamental display assembly having decorative elements rotated in opposite directions, which are actuated by a common power source.

BACKGROUND OF THE INVENTION

Currently, various music box-incorporated ornamental display assemblies have been disclosed and have appeared on the market, such as carrousels or the like. These ornamental display assemblies are rotated or reciprocated by the drive mechanism of a wind-up music box mechanism through a transmission mechanism. However, conventional transmission mechanisms for use with wind-up music box mechanism are commonly complicated and expensive.

In addition, such kinds of devices are often provided with a plurality of decorative ornaments and may be provided with a mechanism, respectively, to cause the decorative ornament to move as the music drum rotates. The decorative ornament is usually mounted on a support member which is associated with the drive mechanism to provide the movement to the decorative ornament.

In order to provide reciprocating movement or rotational movement to different decorative objects of the ornamental display assembly, it is known to use an output shaft of the music drum to provide the power source for the reciprocating movement of a decorative element and to use the unwinding of spring to provide the rotational movement for a separative decorative ornament. When this concept is applied to a variety of movements of the decorative elements, separate drive mechanisms are required and the decorative elements must be laterally spaced apart on the ornamental display assembly. Such a placement inherently requires a complex drive system to provide the desired motion to the decorative ornaments and needs a larger space.

Thus, it is desirable to improve the defects of the prior arts.

SUMMARY OF THE INVENTION

It is one object of the present invention to provide a transmission mechanism for a music box ornament which is simple in structure and inexpensive to manufacture.

It is another object of the present invention to provide an ornamental display assembly having decorative elements rotated in opposite directions, which are actuated by a common power source.

In one preferred embodiment, the transmission mechanism for a music box having a plurality of ornaments coupled thereon includes a drive mechanism disposed in the music box and including a music box mechanism, a rotating device disposed on and driven by the music box mechanism, a first support member mounted on the drive mechanism for supporting a first ornament of the music box and coupled with the rotating device, and a second support member having one end coupled with a second ornament and the other end passing through an axle hole of the first support member and connected to a rotating shaft of the drive mechanism. When the drive mechanism is actuated, the first support member is driven by the rotating device while the second support member is rotated by the rotating shaft of the drive mechanism, thereby respectively causing the first and second ornaments to rotate in different manners.

In a specific embodiment, the transmission mechanism further includes a following device disposed on the drive mechanism and between the first support member and the rotating device for being coupled with the first support member and the rotating device to cause the first support member to rotate in a direction opposite to that of the second support member. The outer diameter of the second support member is slightly less than an inner diameter of the axle hole of the first support member such that the first support member is freely driven by the following device.

In addition, the transmission mechanism further includes a support plate mounted on the drive mechanism and having two lugs extending from one surface thereof corresponding to two holes of the drive mechanism, respectively, for securing the support plate on the drive mechanism, and a lug extending out of the other surface thereof for rotatably securing the following device thereon. Preferably, the following device is a following gear and the rotating device is an active gear, both of which can be engaged with each other.

The first support member includes an axle gear engaged with the following gear, a flange extended from one side of the axle gear for supporting the cover, and an axle journal extended around the axle hole of the first support member to be hitched on the rotating shaft of the drive mechanism. Preferably, the axle gear, the flange, and the axle journal are integrally formed together.

The present invention may best be understood through the following description with reference to the accompanying drawings, in which:

DETAILED DESCRIPTION OF THE PREFERRED EMBODIMENT

The present invention will now be described more detailedly with reference to the following embodiments. It is to be noted that the following descriptions of the preferred embodiments of this invention are presented herein for the purpose of illustration and description only. It is not intended to be exhaustive or to be limited to the precise form disclosed.

Figure 1:
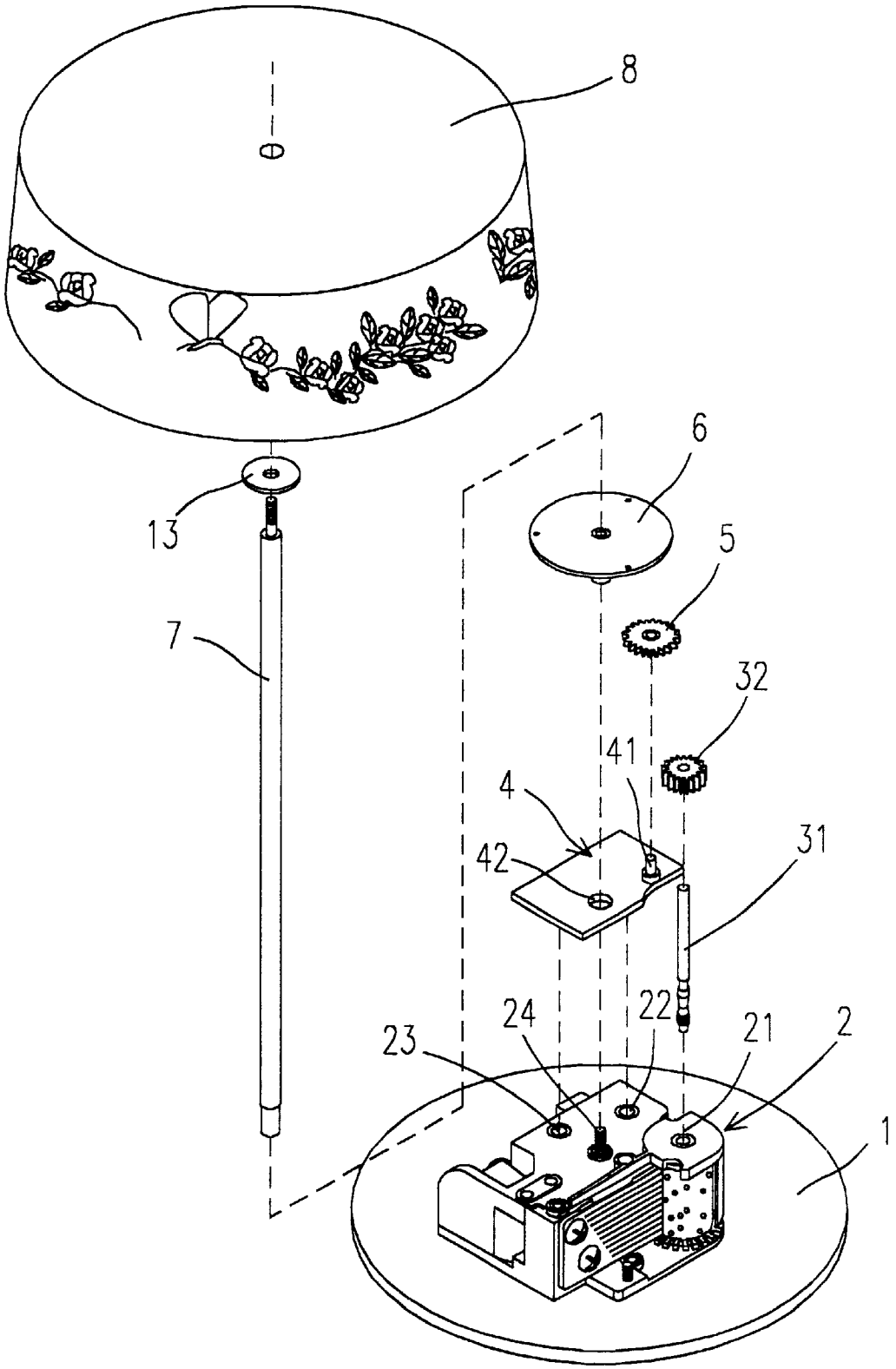
FIG. 1 is an exploded view of a preferred embodiment of a transmission mechanism for a music box ornament according to the present invention.
Figure 2A:
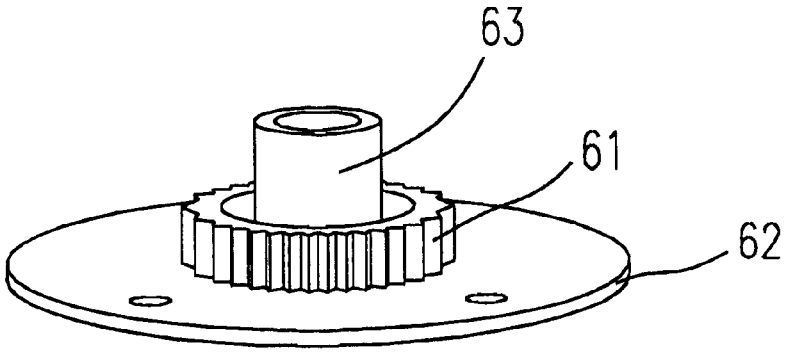
FIG. 2*a* is a bottom view of the first support member shown in FIG. 1.
Figure 2B:
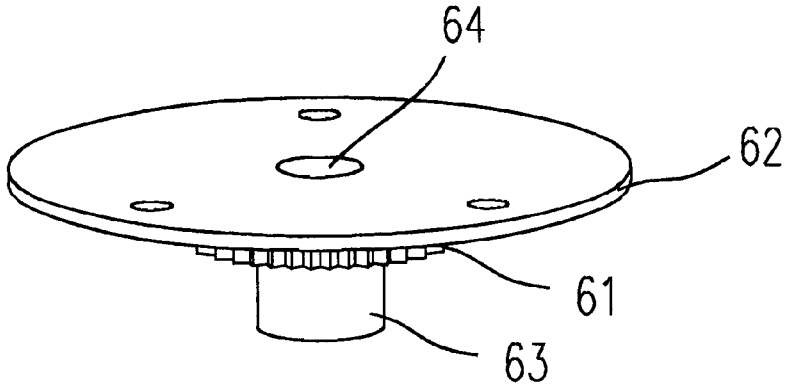
FIG. 2*b* is a top view of the first support member shown in FIG. 1.

Please refer to FIG. 1 showing a preferred embodiment of a transmission mechanism for a music box ornament according to the present invention. The transmission mechanism mainly includes a common drive mechanism 2, a first support member 6, and a second support member 7. The common drive mechanism 2 is mounted on a base 1 of the music box and includes an active gear 32 mounted on the music drum by inserting a pin 31 through a hole of the active gear into an axle hole 21 of the music drum. The first support member 6 includes an axle gear 61, a flange 62 extended from one side of the axle gear 61, and an axle journal 63 extended around the axle hole 64 of the first support member 6, as shown in FIGS. 2*a* and 2*b*. The axle gear 61, the flange 62, and the axle journal 63 can be integrally formed together and can be made of plastic material. The flange 62 of the first support member is used to support a cover 8 with the first ornament of the music box. The size of the flange 62 can be optionally increased to stably support the cover 8 with the first ornament. Preferably, the cover 8 with the first ornament is adhered to the flange 62 to prevent the cover from falling off.

The other end of the second support member 7 is inserted through the axle hole 64 (referring to FIGS. 1 and 2*b*) of the first support member and then connected to a rotating shaft 24 of the drive mechanism 2 by screwing such that the first support member 6 and the second support member 7 can be coaxially arranged on the drive mechanism 2. The outer diameter of the lower end of the second support member 7 is slightly smaller than the inner diameter of the axle hole 64 of the first support member so that the first support member can be freely driven by the active gear 32 when the axle gear 61 is engaged with the active gear 32. In order to prevent the first support member from falling off, the outer diameter of the upper portion of the second support member is designed to be slightly bigger than the inner diameter of the axle hole of the first support member for securing the first support member. The one end of the second support member 7 passes through a central hole of the cover 8 with the first ornament of the music box and then is coupled with the second ornament, wherein a washer 13 can be sleeved into the one end of the second support member 7 to support the second ornament. After all components of the transmission mechanism are assembled together, the first support member can be driven to rotate by the active gear driven by the music drum and the second support member can be rotated about an axis of rotation by the rotatable shaft 24 of the common drive mechanism 2 as the drive mechanism is actuated, wherein the rotating directions of the first and second support members may be the same but the rotation speeds of them are different.

Figure 3A:
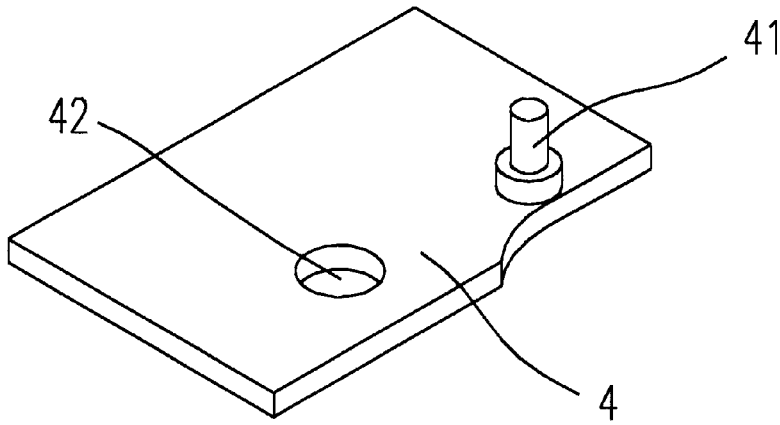
FIG. 3*a* is a top view of the support plate shown in FIG. 1.
Figure 3B:
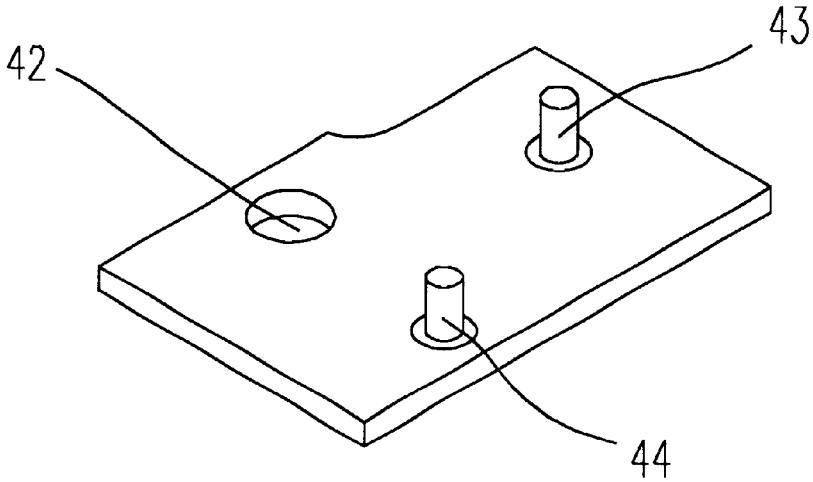
FIG. 3*b* is a bottom view of the support plate shown in FIG. 1.
Figure 4:
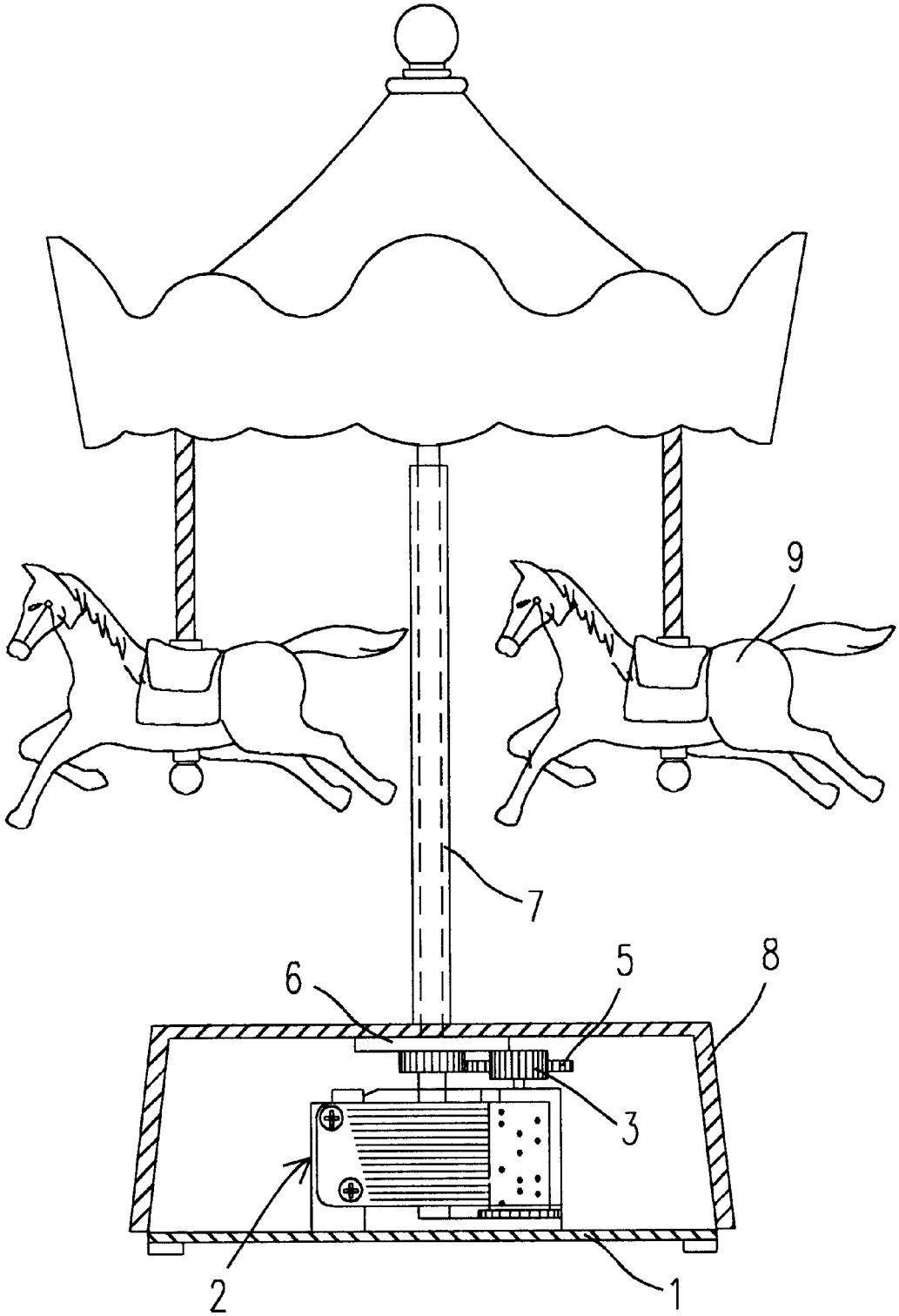
FIG. 4 is a schematic diagram showing the first preferred embodiment of transmission mechanism assembled with a music box according to the present invention.

Alternatively, the transmission mechanism further includes a support plate 4 which has one lug 41 extended out of an upper surface thereof (as shown in FIG. 3*a*), two lugs 43, 44 extended out of a lower surface thereof (as shown in FIG. 3*b*), and a through hole 42. Preferably, these lugs can be integrally formed with the support plate and the support plate can be made of plastic material. The support plate 4 is mounted on the drive mechanism 2 by inserting the two lugs 43, 44 into two holes 22, 23 existing on the drive mechanism 2, respectively. The transmission mechanism further includes a following device 5 (e.g. a following gear) secured on the lug 41 of the support plate 4 (or the following device 5 can be directly mounted on the drive mechanism 2) and between the axle gear 61 of the first support member and the active gear 32 for being engaged with each other to cause the first support member 6 to rotate in a direction opposite to that of the second support member 7. Thus, as shown in FIG. 4, the second ornament 9 coupled on the one end of the second support member 7 and the cover 8 with the first ornament supported and driven by the first support member 6 can be rotated in opposite directions. In other words, when the drive mechanism 2 is actuated, the second ornament 9 is rotated in a clockwise direction and the cover 8 with the first ornament is rotated in a counter clockwise direction.

Figure 5:
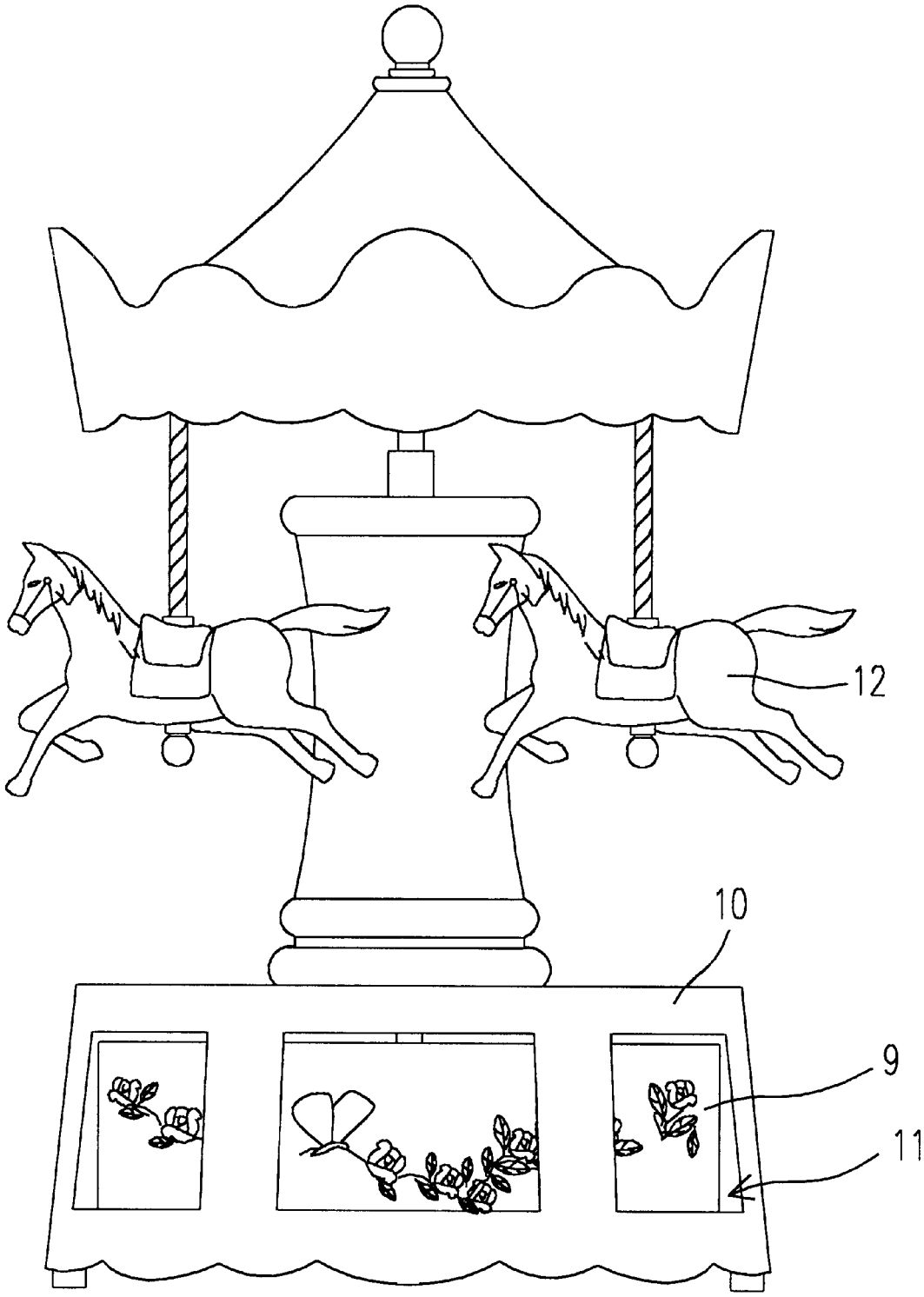
FIG. 5 is a schematic diagram showing the second preferred embodiment of transmission mechanism assembled with a music box according to the present invention.

In the second preferred embodiment of the present invention, the transmission mechanism can be assembled with a music box as shown in FIG. 5. Its rotating principle is identical to that of the above-described embodiment except that an outer cover 10 is further covered outside an inner cover 9 (equivalent to the cover 8 with the first ornament shown in FIG. 4) and coupled with the base 1 of the music box and has a plurality of openings 11 to show different patterns on the inner cover when the inner cover 9 is rotated. Certainly, the second ornament 12 coupled with the second support member is also rotated in a direction opposite to that of the inner cover 9.

Figure 6A:
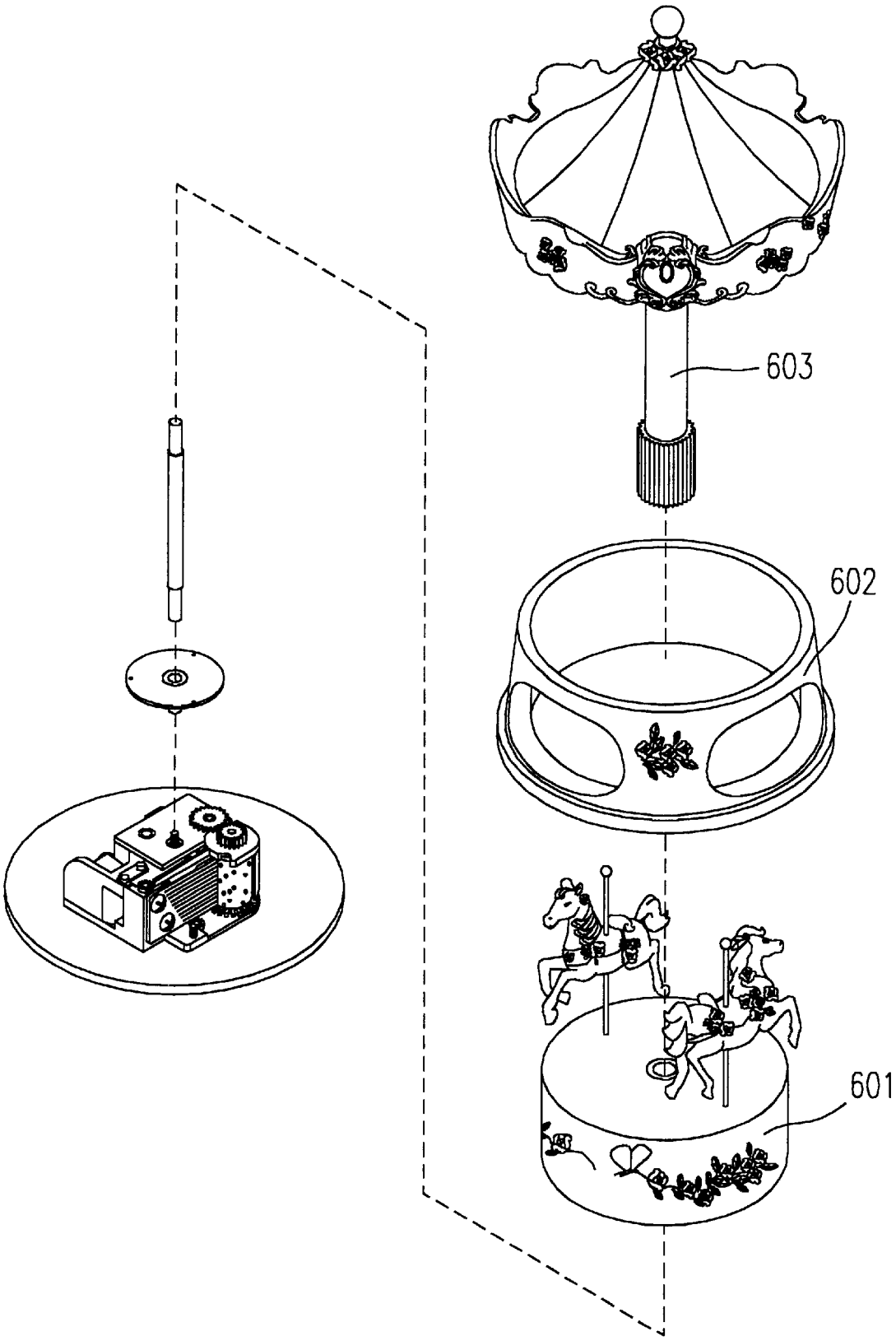
FIG. 6*a* is an exploded view of the third preferred embodiment of transmission mechanism assembled with a music box according to the present invention.
Figure 6B:
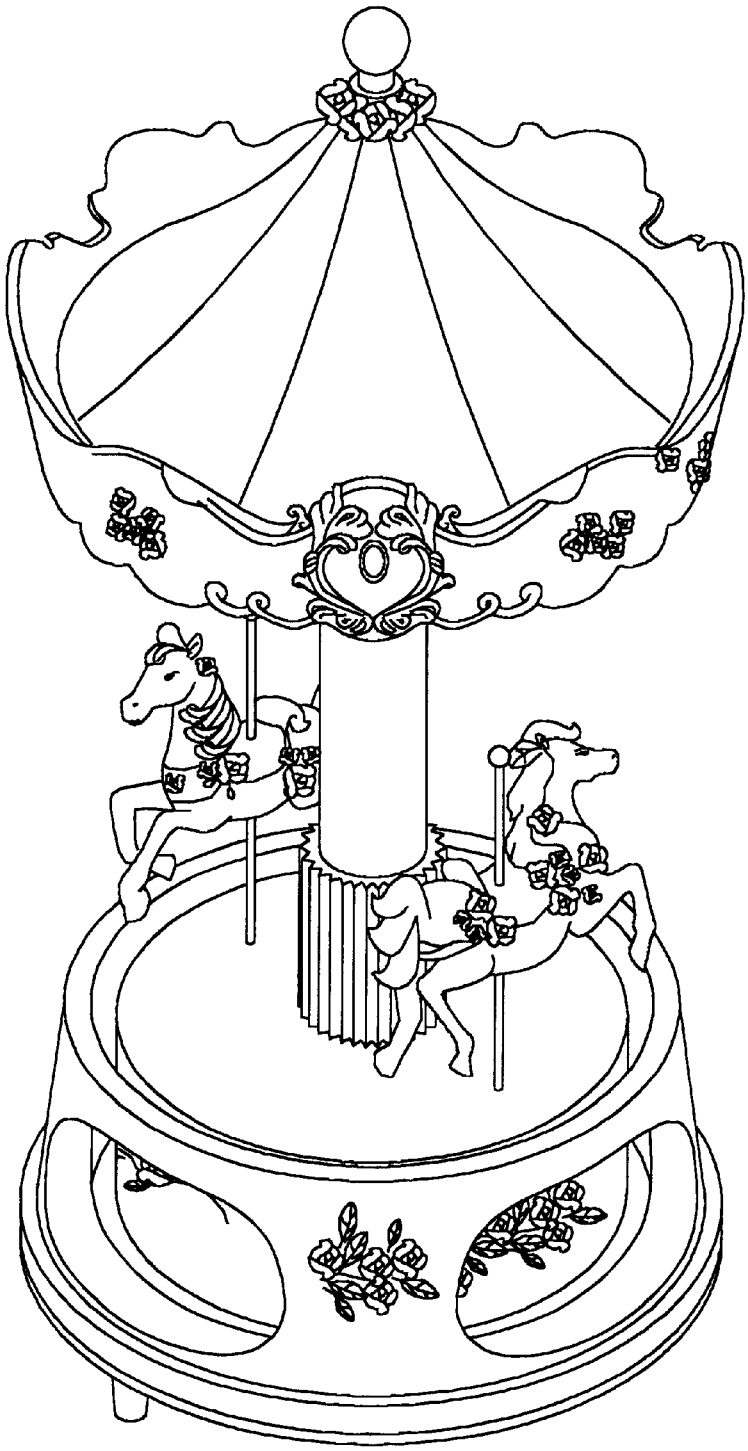
FIG. 6*b* shows the assembled diagram of FIG. 6*a;*

In addition, FIGS. 6*a* and 6*b* show the third preferred embodiment of transmission mechanism assembled with a music box according to the present invention. The transmission mechanism and its rotating principle are identical to those of the second embodiment except that there are several ornaments mounted on the cover 601 and the outer cover is replaced by an immobile housing 602 with a plurality of openings to be coupled with the base. Another ornament with a supporter 603 is coupled with the elongated support member. As the drive mechanism is actuated, the ornament with a supporter 603 is rotated in a clockwise direction and the cover with several ornaments 601 is rotated in a counter clockwise direction. The patterns on the peripheral surface of the cover can be shown through the openings of the immobile housing 602 as the cover 601 is rotated.

Figure 7A:
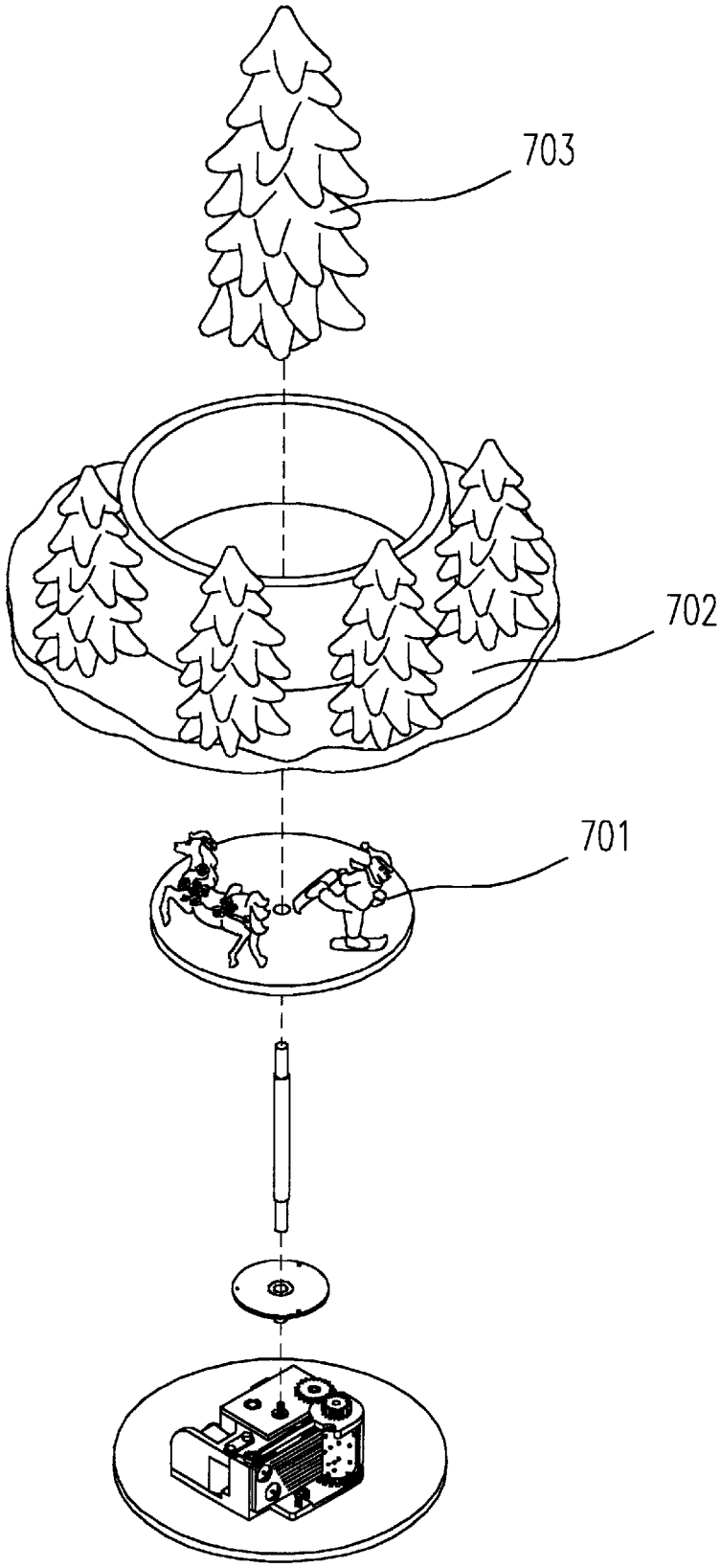
FIG. 7*a* is an exploded view of the fourth preferred embodiment of transmission mechanism assembled with a music box according to the present invention.
Figure 7B:
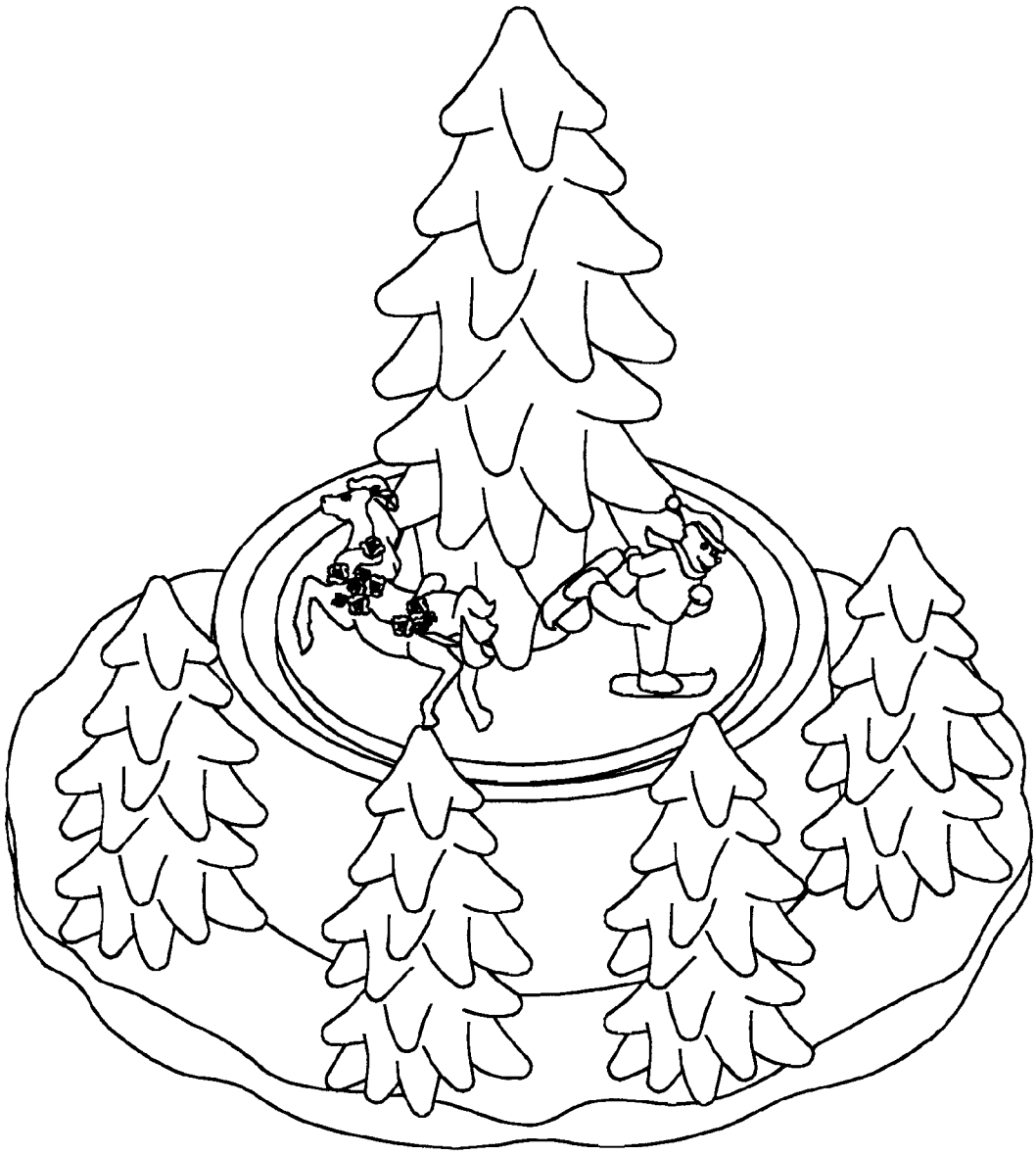
FIG. 7*b* shows the assembled diagram of FIG. 7*a.*

Alternatively, please refer to FIGS. 7*a* and 7*b* which show the fourth preferred embodiment of the present invention. The transmission mechanism and its rotating principle are also identical to those of the second embodiment except that the inner cover is replaced by a plate and there are several ornaments mounted on the plate 701 and the outer cover is replaced by an immobile housing 702 to be coupled with the base. Another ornament 703 is coupled with the elongated support member. As the drive mechanism is actuated, the ornament 703 is rotated in a clockwise direction and the decorative plate 701 is rotated in a counter clockwise direction.

In conclusion, the present invention provides a transmission mechanism for a music box ornament which is simple in structure and inexpensive to manufacture. The assembled ornamental display of the present invention has several decorative elements rotated in different manners (e.g. at different rates or different directions), which can be actuated by a common power source. Thus, the manufacturing cost and the required space can also be significantly reduced.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transmission mechanism for a music box having a plurality of ornaments coupled thereon, comprising:

a drive mechanism disposed in said music box;

a rotating device disposed on said drive mechanism and driven by said drive mechanism;

a first support member mounted on said drive mechanism for supporting a first ornament in said music box and coupled with said rotating device; and a second support member having one end coupled with a second ornament in said music box and another end connected to a rotating shaft of said drive mechanism;

whereby, when said drive mechanism is actuated, said first support member is driven by said rotating device while said second support member is rotated by said drive mechanism, thereby respectively causing said first and second ornaments to rotate in opposite directions.

2. The transmission mechanism of claim 1 further comprising a following device disposed on said drive mechanism and between said first support member and said rotating device for being coupled with said first support member and said rotating device to cause said first support member to rotate in a direction opposite to that of said second support member.

3. The transmission mechanism of claim 2 wherein an outer diameter of a lower end of said second support member is slightly less than an inner diameter of an axle hole of said first support member such that said first support member is freely driven by said following device when said other end of said second support member is inserted through said axle hole of said first support member.

4. The transmission mechanism of claim 2 further comprising a support plate mounted on said drive mechanism and having two lugs extending from one surface thereof corresponding to two holes of said drive mechanism, respectively, for securing said support plate on said drive mechanism, and a lug extending out of the other surface thereof for rotatably securing said following device thereon.

5. The transmission mechanism of claim 2 wherein said following device is a following gear and said rotating device is an active gear, both of which are engaged with each other.

6. The transmission mechanism of claim 5 wherein said active gear is mounted on said drive mechanism by a pin inserted through a hole in said active gear into an axle hole of said drive mechanism.

7. The transmission mechanism of claim 5 wherein said first support member includes:

an axle gear engaged with said following gear;

a flange extended from one side of said axle gear for supporting said cover; and an axle journal extended around said axle hole of said first support member to be hitched on said rotating shaft of said drive mechanism.

8. The transmission mechanism of claim 7 wherein said axle gear, said flange, and said axle journal are integrally formed together.

9. The transmission mechanism of claim 1 wherein said other end of said second support member is connected to a rotating shaft of said drive mechanism by being screwed onto said rotating shaft.

10. An ornamental display assembly comprising:

a base;

first and second coaxially arranged support members;

a common drive mechanism mounted on said base and coupled to said first and second coaxially arranged support members for causing said first and second support members to rotate in opposite directions; and a rotating device mounted on and driven by said common drive mechanism and coupled with said first support member, thereby resulting in the rotation of said first support member.

11. The ornamental display assembly according to claim 10 wherein said second support member has one end connected to a rotating shaft of said common drive mechanism for causing the rotation of said first support member about an axis of rotation.

12. The ornamental display assembly according to claim 10 wherein said common drive mechanism further includes a following device disposed between said rotating device and said first support member to cause said first support member to rotate in a direction opposite to that of said second support member.

13. The ornamental display assembly of claim 12 wherein said following device is a following gear and said rotating device is an active gear, both of which are engaged with each other.

14. The ornamental display assembly of claim 13 wherein said first support member includes:

an axle gear engaged with said following gear;

a flange extended from one side of said axle gear for supporting said cover; and an axle journal extended around an axle hole of said first support member to be hitched on a rotating shaft of said drive mechanism.

15. The ornamental display assembly of claim 14 wherein said axle gear, said flange, and said axle journal are integrally formed together.

16. The ornamental display assembly of claim 12 further comprising a support plate mounted on said drive mechanism and having two lugs extending from one surface thereof corresponding to two holes of said drive mechanism, respectively, for securing said support plate on said drive mechanism, and a lug extending out of the other surface thereof for rotatably securing said following device thereon.

17. The ornamental display assembly according to claim 12 further comprising:

a first decorative object supported and driven by said first support member so as to rotate therewith; and a second decorative object connected to said second support member so as to rotate therewith in a direction opposite to that of said first decorative object.

18. The ornamental display assembly according to claim 17 wherein said first decorative object is one of a decorative cover and a decorative plate.

19. The ornamental display assembly according to claim 18 wherein said first support member has a flange for supporting said first decorative object.

20. The ornamental display assembly according to claim 19 wherein said first decorative object is adhered to said flange of said first support member.

21. The ornamental display assembly according to claim 18 further comprising an additional cover with a plurality of openings, which is covered outside said decorative cover and coupled with said base to show any pattern on said decorative cover via said plurality of openings as said decorative cover is rotated.

22. The ornamental display assembly according to claim 18 further comprising a housing with a plurality of openings, which is disposed around said decorative cover and coupled with said base to show any pattern on said decorative cover via said plurality of openings as said decorative cover is rotated.

23. The ornamental display assembly according to claim 18 further comprising an immobile housing disposed around said decorative plate and coupled with said base.

* * * * *